United States Patent [19]

Owens

[11] 4,335,007

[45] Jun. 15, 1982

[54] SOAP BAR

[76] Inventor: Dovie A. Owens, Rte. 2, Box 460, Fulton, Miss. 38843

[21] Appl. No.: 240,543

[22] Filed: Mar. 4, 1981

[51] Int. Cl.[3] ..... C11D 17/00; C11D 17/04

[52] U.S. Cl. ..... 252/92; 252/134; 252/174; 252/DIG. 16

[58] Field of Search ..... 252/92, 134, 174, DIG. 16

[56] References Cited

U.S. PATENT DOCUMENTS

| | | | |
|---|---|---|---|
| 3,677,951 | 7/1972 | Alles | 252/92 |
| 4,203,857 | 5/1980 | Dugan | 252/92 |

FOREIGN PATENT DOCUMENTS

| | | | |
|---|---|---|---|
| 27511 | 2/1903 | Fed. Rep. of Germany | 252/92 |
| 2825529 | 12/1979 | Fed. Rep. of Germany | 252/92 |
| 277943 | 9/1951 | Switzerland | 252/92 |

*Primary Examiner*—Dennis L. Albrecht

[57] ABSTRACT

A soap cake and method of manufacture is provided having a substantially water insoluble base portion to retard deterioration of the soap bar from the bottom. The soap is molded to the base and is retained in connection with the base through the provision of surface interruptions in the top surface of the base having wall portions extending at an angle to align normal to the top surface of the base so as to lock the cake to the base during the cake molding operation.

1 Claim, 8 Drawing Figures

FIG. 1
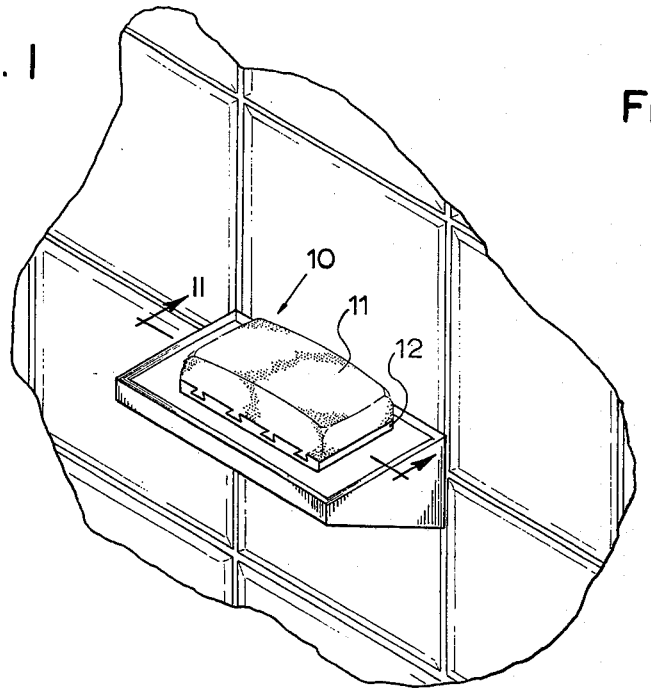
FIG. 8
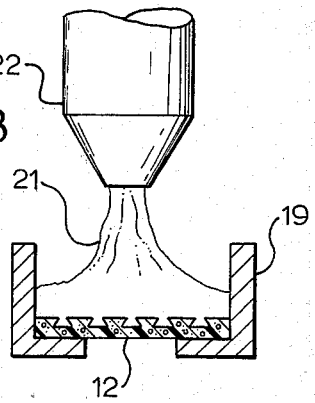
FIG. 7
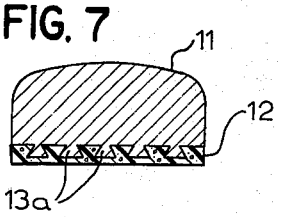
FIG. 2
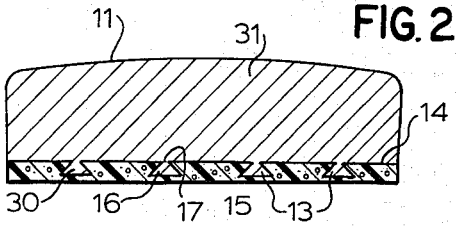
FIG. 3
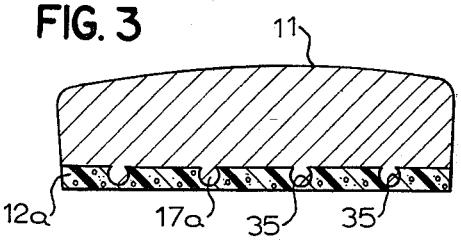
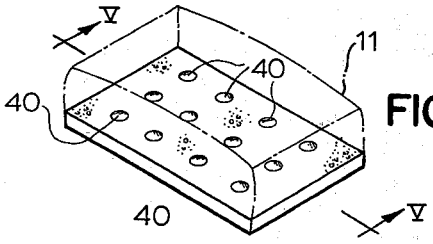
FIG. 4
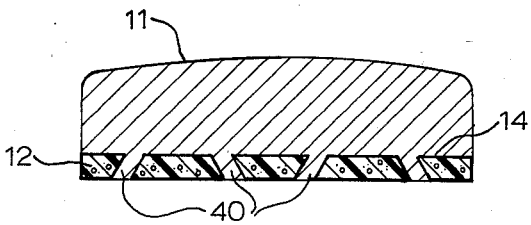
FIG. 5
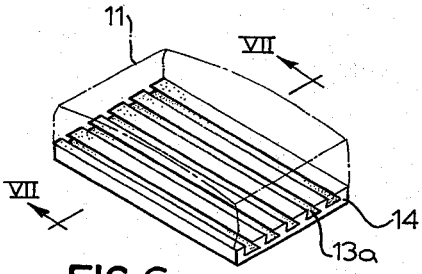
FIG. 6

SOAP BAR

BACKGROUND OF THE INVENTION

1. Field of the Invention

This invention relates to soap manufacturing and, more particularly to bar soap manufacturing.

2. Prior Art

A well recognized disadvantage of cake soap or bar soap is the deterioration which the soap undergoes when it is left in the soap dish. This deterioration is, of course, accounted for due to the water which remains on the bar of soap after use and which settles to the bottom of the soap dish remaining in contact with the bar or cake of soap. Numerous attempts have been made to reduce or eliminate this deterioration and, for the most part, have involved devices to elevate the soap above the bottom of the soap dish such as shown in U.S. Pat. No. 680,052, or various forms of soap holders which prevent the bottom of the soap from coming into contact with the water residue in the soap dish. Such soap holders can be formed attached to the soap bar as shown in U.S. Pat. No. 702,531, or formed as separate devices as shown in U.S. Pat. No. 1,571,842, and U.S. Pat. No. 1,332,096.

Other forms of soap cake holders or bases are shown in, for example, U.S. Pat. Nos. 1,221,939 and 2,603,032.

A common disadvantage of the prior soap holders is that they are expensive, cumbersome and, as the bar of soap decreases in size, prone to becoming detached from the soap bar.

It would therefore be an advance in the art to provide an improved soap bar or cake in which a water resistent base of inexpensive material is permanently affixed to the bar of soap at the time of manufacture.

SUMMARY OF THE INVENTION

This invention provides a device and method of making the device, the device comprising a soap bar having a water resistent base member affixed thereto.

It should be understood that the term soap bar or cake as used herein is intended to be used in a broad sense referring to any form of formed slab of water degradable cleansing material, whether natural soap, detergent, beauty bar, or the like.

In accordance with the preferred embodiment of this invention, a base member is formed for the soap cake, the base member being constructed of a water insoluble or water resistent material having a general peripheral outline coextensive with the desired periphery of the soap cake. The base member is formed with surface interruptions for locking the soap bar to the base. The surface interruptions may preferably be formed having at least one wall extending into the body of the base at an acute angle to the surface of the base.

Thereafter, the soap is molded to shape by being first poured over the base when in a flowable state. Thus, the soap will flow into the surface interruptions and, upon hardening of the cake, the soap will be locked to the base due to the surface interruptions.

In a preferred form, the surface interruptions consist of grooves running the length of the base open to the top surface and having a groove transverse dimension below the surface which is greater than the opening of the groove at the surface. In another embodiment of the invention, the surface interruptions may consist of bores which extend obliquely into the base from the base surface at a non-perpendicular angle to the surface of the base.

The base may be formed of any desired material such as, for example, plastics, metals, foamed plastics, and the like.

It is therefore a principal object of this invention to provide an improved soap bar.

It is another, and more specific object of this invention to provide an improved soap bar having a water impervious base affixed to a bar of soap.

It is another, and more specific object of this invention provide an improved soap bar having a base formed with surface interruptions therein, the base being molded to the soap bar during formation of the soap bar.

It is another object of this invention to provide a method of making a soap bar which comprises the steps of providing a water resistent base having a top surface, forming a plurality of surface interruptions in the top surface, flowing a hardenable soap over the base and into the surface interruptions, molding a soap cake above the base, and hardening the soap mixture to fasten the base to the soap cake.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a perspective elevational view of a soap cake according to this invention shown resting in a soap dish.

FIG. 2 is a cross-sectional view of the soap cake in FIG. 1 taken along the line II—II of FIG. 1.

FIG. 3 is a view similar to FIG. 2 showing a modified form of the soap cake.

FIG. 4 is a three quarter plan view of a soap cake base according to this invention illustrating, by dotted lines, the outline of the soap.

FIG. 5 is a cross-sectional view taken along the lines V—V of FIG. 4.

FIG. 6 is a view similar to FIG. 4 showing yet another modified form of this invention.

FIG. 7 is a cross-sectional view taken along the lines VII—VII of FIG. 6.

FIG. 8 is a diagrammatic sectional view showing the molding of a soap bar.

DESCRIPTION OF THE PREFERRED EMBODIMENTS

As illustrated in FIG. 1, the soap bar 10 of this invention consists of a top soap cake 11 and a base 12. As best shown in FIG. 2, the base 12 may be formed of any desired water resistent or water insoluble material. Suitable materials are solid plastics, foamed plastics, metals, etc. The base 12 is formed with a plurality of transverse grooves 13 which extend into the material of the base from a top surface 14 thereof. As is shown in FIG. 2, the grooves 13 have side walls 15 extending into the base at an angle other than normal to the surface 14. In the embodiment shown in FIG. 2, both sides of the groove extend in at opposite angles. This provides a base section 16 of the groove having a side to side dimension greater than the dimension 17 of the opening of the groove at the surface 14.

As illustrated in FIG. 8, the soap bar may be provided by first inserting the base 12 into a mold 19. Thereafter, soap 21 formed from any flowable, hardenable formula is poured into the mold over the base. The soap may be provided from a heated mixer 22 or the like.

It is to be understood that FIG. 8 is illustrative only of a method of manufacturing the soap cake and that a single mold per cake is not required. The base can originally be formed, if desired, having a dimension sufficient to support a large plurality of cakes, with the individual cakes being cut after molding a single multi-cake slab. During such cutting process, the base will also be cut.

Although, in FIGS. 1 and 2, the grooves 13 are shown as being transverse the longitudinal major axis of the soap bar; as shown in FIGS. 6 and 7, if desired, the grooves 13a may be formed aligned with the major axis of the soap bar.

After molding of the soap bar, the soap mixture is allowed to harden and subsequent finishing operations can be provided. During the hardening, the soap in the grooves 30 will be intergrally affixed to the soap 31 of the cake portion 11 such that the base will be firmly locked to the cake.

Due to the angle of the walls 15, the soap cake cannot be removed from the base without fracturing a large portion of the soap since the grooves extend the full width of the soap bar.

As shown in FIG. 3, the same effect can be accomplished by providing round grooves 35 in the base 12a. By submerging the grooves partially in the base beyond the major diameter, again, the opening 17*a* to the grooves will have a smaller dimension than the major diameter of the groove.

As shown in FIGS. 4 and 5, the same locking effect can be obtained by providing a plurality of individual cylindrical or other shaped bores 40 extending into, or through the base, with the bores being formed at an angle to the surface 14 of the base. The groove wall then will lie at an angle to the surface other than perpendicular thereto.

The particular soap mixture to be used forms no part of this invention and any soap mixture which is initially flowable and capable thereafter of hardening is believed suitable. Although a rectangular flat base has been illustrated, it is of course to be understood that the base can, if desired, be curved or otherwise shaped to any desirable, aesthetically pleasing form and may, if desired, be formed of flexible material.

Of course a reversal of the above described method may also be practical. That is the soap cake can be formed in a bottom female mold with a water resistent base member having grooves or apertures as discussed above impressed into the cake before it is hardened. The resultant cake would still be as shown in FIGS. 1 through 7. This method would allow the continued use of existing soap molds in the practice of this invention.

It will therefore be seen from the above that this invention provides an improved soap cake having a base member locked to the soap cake during the formation of the soap cake. The base member is formed of a water resistent material having surface interruptions in a top surface thereof, the interruptions having side walls formed at an angle other than perpendicular to the base surface. In a preferred embodiment the surface interruptions have a dimension interior of the base greater than the dimension opening the surface interruption to the base surface.

Although the teachings of my invention have herein been discussed with reference to specific theories and embodiments, it is to be understood that these are by way of illustration only and that others may wish to utilize my invention in different designs or applications.

I claim as my invention:

1. A soap cake comprising a base member formed of a water stable material, said base member having a top surface, a plurality of surface interruptions formed in said top surface extending into said base member, said surface interruptions having wall portions extending into said base member at a non-perpendicular angle to the surface, a soap bar formed above said base on said base having portions thereof extending into said surface interruptions and filling said surface interruptions, said surface interruptions formed as bores extending into the base having bore walls lying at a non-perpendicular angle to the base, a first plurality of said bores having walls lying at a first angle to the perpendicular to the base and a second plurality of said bores having walls lying at a second angle to the perpendicular to said base, said second angle being different than said first angle and opposed thereto.

* * * * *